United States Patent [19]

Oyaide et al.

[11] Patent Number: 5,018,889

[45] Date of Patent: May 28, 1991

[54] SHEET CONVEYING APPARATUS FOR A PRINTER

[75] Inventors: Shinichi Oyaide, Shizuoka; Masayoshi Kawahira; Toshio Miyazawa, both of Mishima, all of Japan

[73] Assignee: Tokyo Electric Co., Ltd., Tokyo, Japan

[21] Appl. No.: 477,236

[22] Filed: Feb. 8, 1990

[30] Foreign Application Priority Data

Feb. 15, 1989 [JP] Japan ..... 1-35887
Apr. 4, 1989 [JP] Japan ..... 1-39919[U]
Jul. 25, 1989 [JP] Japan ..... 1-87123[U]

[51] Int. Cl.[5] ..... B41J 13/32

[52] U.S. Cl. ..... 400/642; 400/636; 400/636.3

[58] Field of Search ..... 400/634, 636, 636.1, 400/636.3, 637, 637.3, 637.4, 639, 642, 578; 271/3, , 272, , 273, 302, 303

[56] References Cited

U.S. PATENT DOCUMENTS 4,448,559 5/1984 Matsuda et al. ..... 400/637.4
4,717,274 1/1988 Kimura ..... 400/636.1
4,867,437 9/1989 Wise ..... 271/303
4,898,488 2/1990 Yokoi et al. ..... 400/642
4,971,468 11/1990 Yokoi ..... 400/634

FOREIGN PATENT DOCUMENTS 56173 3/1987 Japan ..... 400/636
263079 11/1987 Japan ..... 400/636
63-64320 12/1988 Japan ..... 400/636

*Primary Examiner*—Edgar S. Burr
*Assistant Examiner*—Ren Yan
*Attorney, Agent, or Firm*—Frishauf, Holtz, Goodman & Woodward

[57] ABSTRACT

A sheet conveying apparatus for printer, comprises an apparatus body with first and second sheet exhaust ports, a printing unit provided in the apparatus body, a paid of feeding rollers for feeding a sheet to the printing unit, and a pair of exhaust rollers for exhausting the sheet from the printing unit. The apparatus body has a support frame for rotatably carrying one of the feeding rollers and one of the exhaust rollers. The contact force of the feeding rollers and the contact force of the exhaust rollers are simultaneously adjusted by an eccentric roller. Further, the apparatus body has a sheet exhaust direction changing mechanism for selecting one of the sheet exhaust ports in accordance with the type of sheet, in cooperation with the movement of the support frame.

10 Claims, 5 Drawing Sheets

SHEET CONVEYING APPARATUS FOR A PRINTER

BACKGROUND OF THE INVENTION

1. Field of the Invention

The present invention relates generally to a sheet conveying apparatus for a printer, and more particularly to a sheet conveying apparatus comprising rollers for conveying various types of sheets to a printing unit and exhaust ports, and a sheet exhaust guide for selecting one of the exhaust ports in accordance with the thickness of the sheet.

2. Description of the Related Art

When printing is effected on a continuous sheet (e.g. a fanfold sheet) and a non-continuous sheet (a thin sheet of "B5" size or the like, or a relatively thick and hard sheet such as a postcard) with use of a single printer, the following problems occur:

(1) In order to ensure the exact feeding of sheets, it is necessary that the contact state of a pair of driven and driving rollers on the upstream side of a printing unit and the contact state of a pair of driven and driving rollers on the downstream side of the printing unit be adjusted in accordance with the type of sheets.

For example, when a thin non-continuous sheet is subjected to printing, it is necessary that both driven rollers on the upstream and downstream sides of the printing unit be brought into contact with the associated driving rollers with a predetermined contact force. However, when a thick non-continuous sheet is subjected to printing, this contact force needs to be slightly weakened.

In the prior art, the contact state of the upstream-side rollers and the contact state of the downstream-side rollers have been adjusted independently, resulting in complex structure of the apparatus.

(2) In order for an operator to easily take out a printed sheet from an exhaust port, it is desirable that the exhaust port is provided in the uppe part of the printer. However, in the conventional apparatus, a printed sheet is often inverted while it is conveyed to the exhaust port; therefore, wrinkles may appear on a relatively thick and hard sheet such as a postcard. For this reason, the printer has upper and lower exhaust ports. In this case, the operator operates an exhaust guide according to the type of sheet, thus selecting one of the exhaust ports. However, the operator often forgets to select the exhaust port, and a trouble of exhaust of sheets may occur.

SUMMARY OF THE INVENTION

The object of the present invention is to provide a sheet conveying apparatus for a printer, wherein the contact state of the driven and driving rollers on the upstream side of the printing unit and the contact state of the driven and driving rollers on the downstream side thereof can be easily adjusted, with no trouble of exhaust of sheets.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

The structure of a sheet conveying apparatus for a printer, according to an embodiment of the present invention, will now be described with reference to FIGS. 1 to 4.

Figure 1:
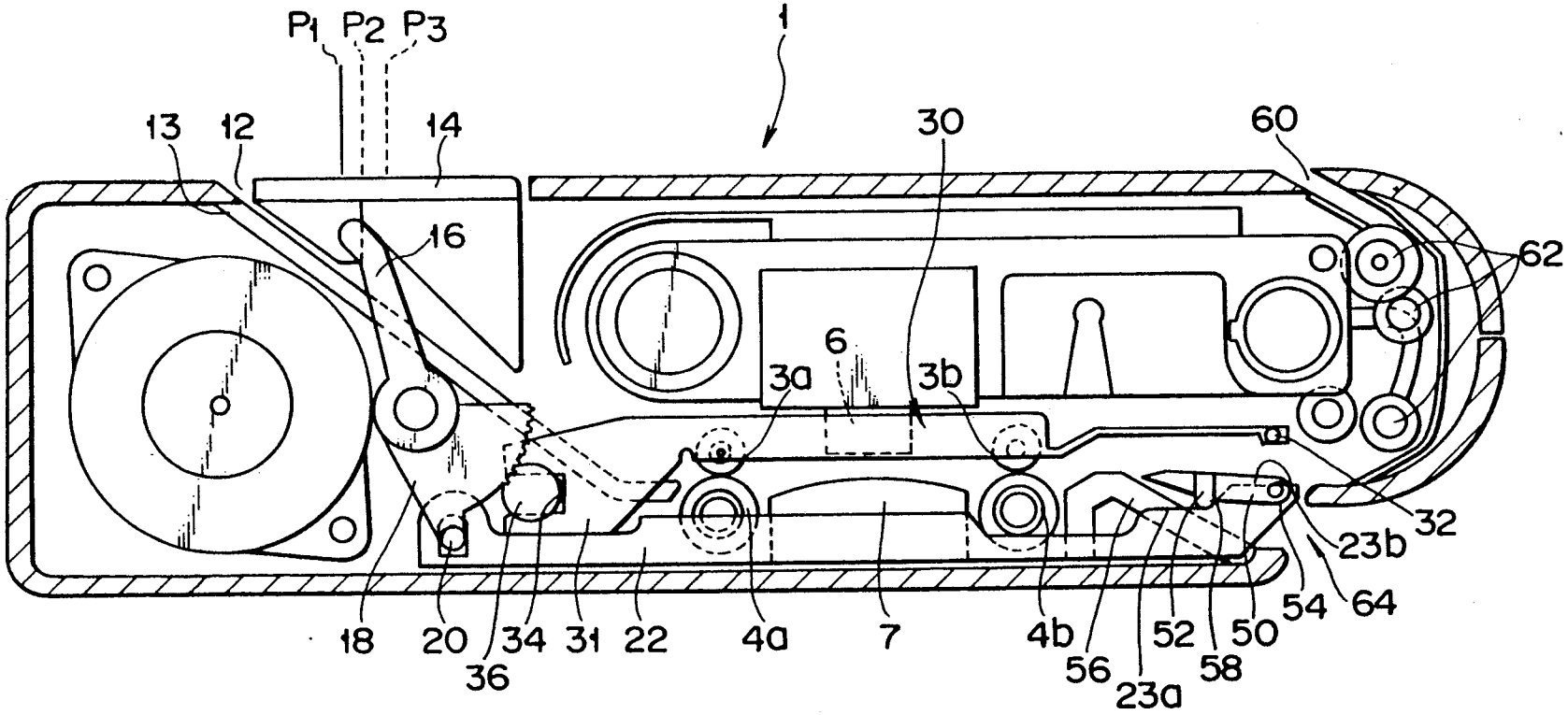
FIG. 1 shows an entire structure of a sheet conveying apparatus for a printer, according to an embodiment of the present invention.

In FIG. 1, reference numeral 1 denotes a printer body, and numeral 6 denotes a printing head provided in the body 1 for effecting printing on various sheets. A platen 7 is provided so as to face the printing head 6. The printing head 6 and the platen 7 constitute a printing unit. The printing unit is interposed between a pair of feeding rollers 3*a* and 4*a*, on one hand, for feeding paper sheets to the printing unit, and a pair of exhaust rollers 3*b* and 4*b*, on the other hand, for exhausting printed sheets. In this embodiment, the upper rollers 3*a* and 3*b* are designed as driven rollers, and the lower rollers 4*a* and 4*b* are designed as driving rollers. Of course, the driven rollers may be either the upper rollers 3*a* and 3*b* or the lower rollers 4*a* and 4*b*. In FIG. 1, driving means for driving the rollers is not shown.

Sheets ar conveyed from the left side (upstream side) of the printing unit to the right side (downstream side) thereof.

The driving rollers 4*a* and 4*b* are rotatably fixed to the printer body 1 by support means (not shown).

A convey unit 30 extends from the upstream side of the printing unit to the downstream side thereof. The contact forces of the feeding rollers 3*a* and 4*a* and exhaust rollers 3*b* and 4*b* ar adjusted simultaneously by the convey unit 30. The contact forces are different from each other in accordance with the thickness of the sheets. When printing is effected on a thin noncontinuous sheet, the driven rollers 3*a* and 3*b* are pressed on the driving rollers 4*a* and 4*b* with a predetermined contact force. When printing is effected on a relatively thick paper sheet such as a postcard, the contact force is weakened, compared to the printing of a thin sheet When a continuous sheet such as a fanfold paper sheet is subjected to printing, a tractor is normally used to feed the sheet to the printing unit. In this case, the feeding rollers 3*a* and 4*a* on the upstream side of the printing unit are not used; therefore, these rollers are separated from each other. On the other hand, the exhaust rollers 3*b* and 4*b* on the downstream side of the printing unit ar brought into contact with each other, since the printed continuous sheet needs to be conveyed to the exhaust port.

Figure 4:
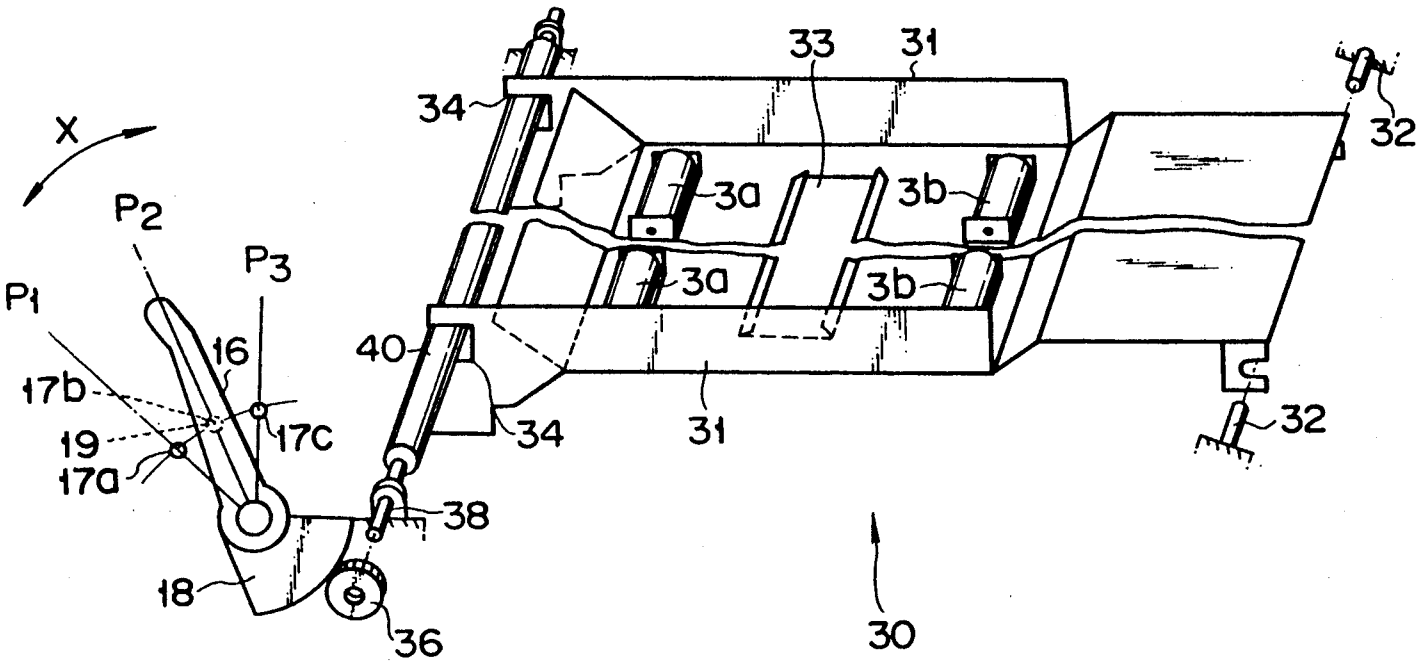
FIG. 4 is a perspective view showing a convey unit of the apparatus shown in FIG. 1.

In a conventional sheet conveying apparatus for a printer for effecting printing on various sheets, when the contact force of the paired feeding rollers on the upstream side of the printing unit and the contact force of the paired exhaust rollers on the downstream side of the printing unit are adjusted, the driven roller on the upstream side is shifted to a greater degree than the driven roller on the downstream side. The present invention has been made in consideration of this point, and the convey unit 30 is constructed, as shown in FIG. 4. A support frame 31, on which the driven rollers 3*a* and 3*b* are rotatably mounted, is swingably attached to a support shaft 32 on the downstream side of the exhaust rollers 3*b* and 4*b*, so that the support frame 31 can be rotated in relation to the printer body 1. The support shaft 32 is attached to the printer body 1 such that, when the support frame 31 is positioned horizontally, the driven rollers 3*a* and 3*b* are brought into contact with the driving rollers 4*a* and 4*b* under a predetermined pressure. The support frame 31 is rotated about the support shaft 32, so that the contact forces of the feeding rollers 3*a* and 4*a* and the exhaust rollers 3*b* and 4*b* can be adjusted simultaneously. Of course, the amount of movement of the driven roller 3*a* is greater than that of the driven roller 3*b*.

The support frame 31 has an opening 33 between the driven rollers 3*a* and 3*b*. The opening 33 allows the printing head 6 to effect printing on sheets on the platen 7.

Driving means for rotatinq the support frame 31 about the support shaft 32 is arranged on the upstream side of the driven roller 3*a* of the support frame 31. The driving means will now be described.

Notches 34 are formed in that portion of the support frame 31, which is located on the upstream side of the driven roller 3*a*. A roller 40 is rotatably engaged in the notches 34, so as to support the support frame 31. The roller 40 has an eccentric shaft 38 of which axis is displaced from the axis of the roller 40. Both ends of the eccentric shaft 38 extend from both end portions of the roller 40. The eccentric shaft 38 is rotatably attached to the printer body 1. When the eccentric shaft 38 is rotated, the roller 40 serves as an eccentric cam so that the support frame 31 is pivoted about the support shaft 32.

The range of pivotated of the support frame 31 depends on the eccentricity of the eccentric shafts 38 in respect of the roller 40. When the support frame 31 is positioned horizontally, the driven rollers 3*a* and 3*b* are brought into contact with the driving rollers 4*a* and 4*b* with a predetermined contact force. In this case, the support frame 31 is not allowed to move in the counterclockwise direction. From this state, the upstream-side portion of the support frame 3 is rotated clockwise and raised, by virtue of the cooperation of the roller 40 and eccentric shaft 38 (eccentric roller). In the highest position of the upstream-side portion of the support frame 31, the driven roller 3*a* is completely separated from the driving roller 4*a*, and the driven roller 3*b* is slightly contacted with the driving roller 4*b*. The eccentricity of the eccentric shaft 38 in respect to the roller 40 is set so that the support frame 31 can pivot in the aforementioned range. Thus, the support frame 31 is pivoted about the support shaft 32 between the horizontal position and the highest position.

A gear 36 for driving the eccentric roller is secured on an end portion of one of the eccentric shaft 38 (in FIG. 4, the shaft 38 on the front side). The gear 36 is engaged with a sector gear 18 for rotating the gear 36. The sector gear 18 is formed integral with an operating member 16 for operating the sector gear 18. The sector gear 18 and the operating member 16 are supported by the printer body 1, so as to be movable in the direction of arrow X (in the figure). In this embodiment, the operating member 16 is moved in three steps in positions P1, P2 and P3. The printer body 1 is provided with a plurality of recesses (three in this embodiment) 17*a*, 17*b* and 17*c* arranged at regular intervals. The operating member 16 has projections 19 that can be engaged in the recesses 17*a*, 17*b* and 17*c*. Thus, the operating member 16 is locked in a predetermined position. In this embodiment, the sector gear 18 and operating member 16 are mounted on the printer body 1, so that the support frame 31 is set in the horizontal position when the operating member 16 is placed in position P1, and the support frame 31 is set in the highest position when the operating member 16 is placed in position P3. In FIG. 4, the operating member 16 is placed in position P2 where the upstream-side portion of the support frame 31 is slightly above the horizontal position.

Referring back to FIG. 1, first and second sheet exhaust ports 60 and 64 are provided on the downstream side of the printer body 1. The first sheet exhaust port 60 is arranged in the upper part of the printer body 1, and the second sheet exhaust port 64 is arranged in the lower part of the printer body 1.

A sheet exhaust guide 50 is arranged near the second sheet exhaust port 64. The guide 50 rotatably attached at one end to the printer body 1 by means of a fixed shaft 54, and the guide 50 serves to direct printed sheets to the first exhaust port 60 or to the second exhaust port 64. The sheet exhaust guide 50 is provided with a projection 52 which engages an operating portion 58 (described later) and allows the guide 50 to rotate smoothly.

A lower end portion of the sector gear 18 is connected to a coupling member 22 via an engaging pin 20. The coupling member 22 extends to the second sheet exhaust port 64. The coupling member 22 moves in the horizontal direction (to the left or right in FIG. 1) when the operating member 16 is set in any one of positions P1, P2 and P3. The operating portion 58 engaging the projection 52 is formed at a downstream-side end portion of the coupling member 22. The operating portion 58 has steps elevating toward the downstream side, and also has two horizontal portions 23*a* and 23*b*. The horizontal portions 23*a* and 23*b* are bridged by a coupling portion 23*c* which is inclined at a predetermined angle. Thus, when the coupling member 22 slides horizontally, the sheet exhaust guide 50 is smoothly rotated by virtue of the cooperation of the projection 52 and coupling portion 23c. As a result, printed sheets are exhausted through the first port 60 or the second port 64. In FIG. 1, the first exhaust port 60 is selected by the guide 50.

Figure 2:
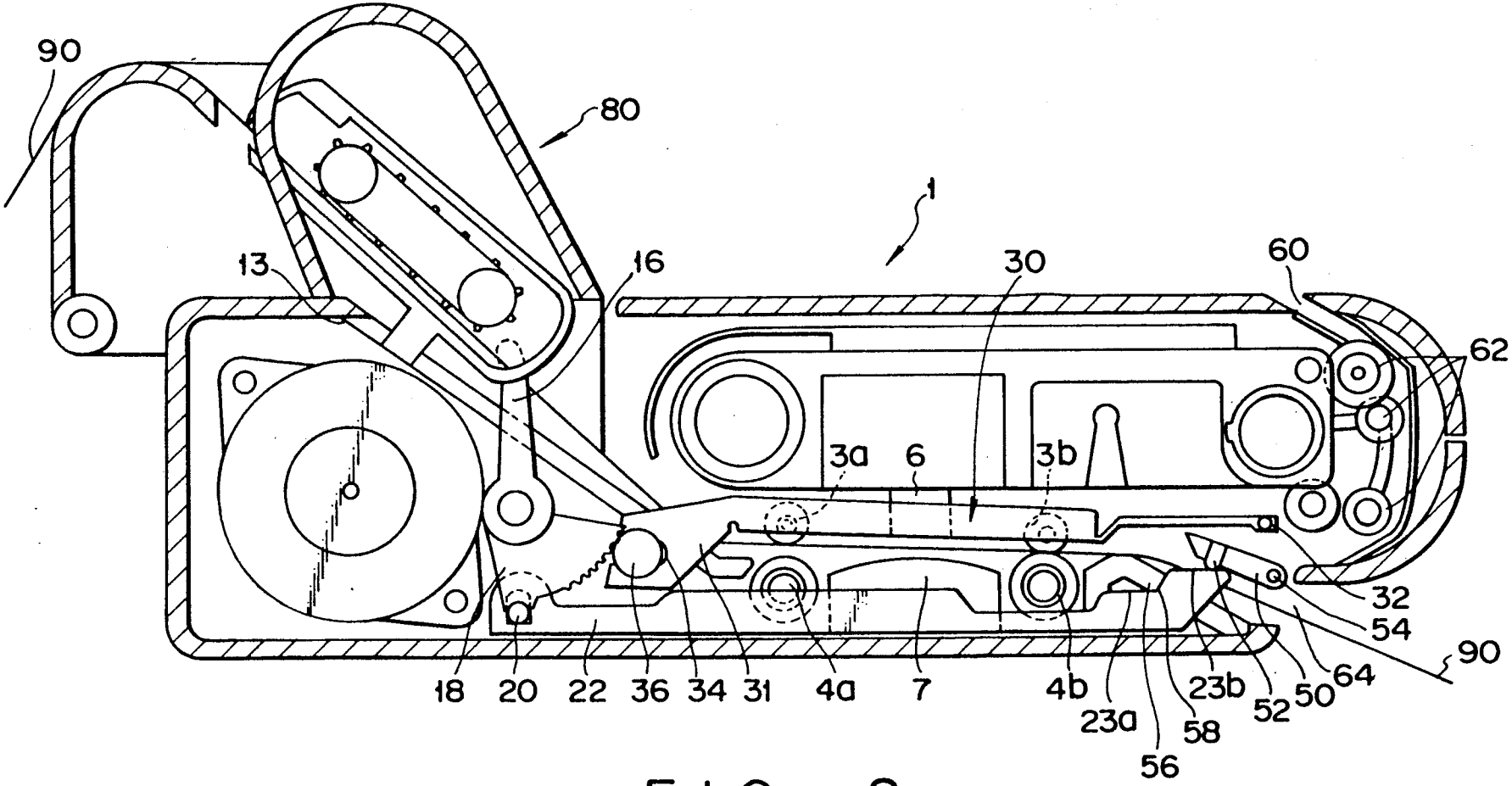
FIG. 2 shows the entire structure of the sheet conveying apparatus shown in FIG. 1, wherein a tractor is provided.
Figure 3A:
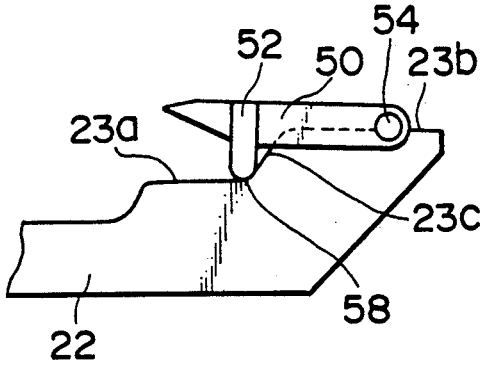
FIGS. 3A to 3C are partially enlarged views showing the states of an exhaust direction changing mechanism, corresponding to the position of an operating member.
Figure 3B:
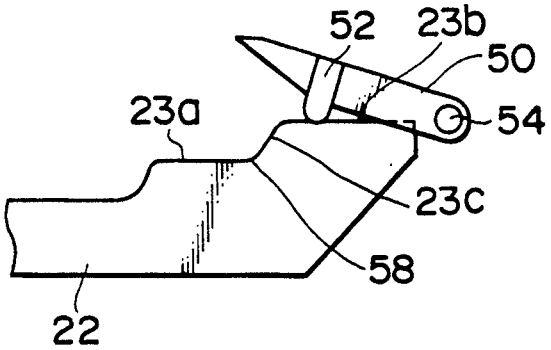
Figure 3C:
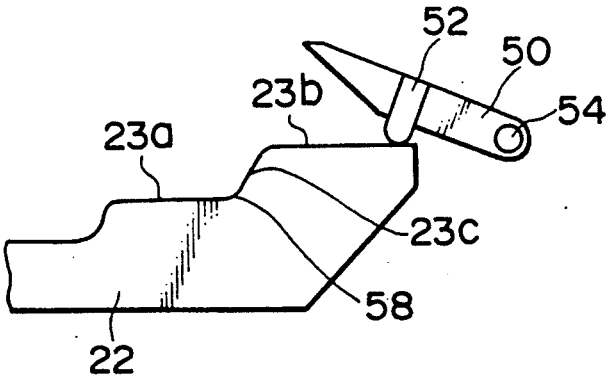

FIGS. 3A to 3C illustrate the relationship between the position of the operating member 16 and the sheet exhaust guide 50. When the operating member 16 is set in position P1, the sheet exhaust guide 50 selects the first exhaust port 60 (FIG. 1 and FIG. 3A). When the operating member 16 is set in position P2 or P3, the guide 50 selects the second exhaust port 64 (FIG. 2 and FIGS. 3B and 3C).

A sheet insert port 12 is provided in the upper part of the printer body 1. Sheets are inserted through the insert port 12. An upper cover 14 is provided adjacent to the sheet insert port 12. The upper cover 14 is removably attached to the printer body 1 by fixing means (not shown). FIG. 2 shows the structure of the printer body wherein the upper cover 14 is replaced with a sheet convey tractor 80 for conveying a continuous sheet. The tractor 80 has a recess (not shown) in which the operating member 16 is inserted. The recess is formed so as to allow the sheet convey tractor 80 to be set on the printer body 1 when the operating member 16 is placed in position P3.

The operation of the sheet conveying apparatus of the present invention will now be described with reference to FIGS. 1 to 4.

Various sheets are inserted from the insert port 12. For example, the sheets include continuous sheets (e.g. fanfold sheets) and non-continuous sheets (e.g. ordinary sheets of "B5" size or the like, hard sheets such as postcards).

First, a description is given of the case of conveying non-continuous sheets. When thin and soft sheets of "B5" size or the like are conveyed, the operating member 16 is set in position P1. In this case, the support frame 31 is positioned horizontally, and the driven rollers 3*a* and 3*b* are brought into contact with the driving rollers 4*a* and 4*b* with a predetermined contact force. Also, the first exhaust port 60 is selected by the sheet exhaust guide 50 (see FIG. 3A). A sheet inserted from the insert port 12 is conveyed along a sheet guide 13 to the driven roller 3*a* and driving roller 4*a*. The sheet is passed through the rollers 3*a* and 4*a*, and printing is effected on the sheet in the printing unit 6 and 7. The printed sheet is then passed through the rollers 3*b* and 4*b* and guided to the first exhaust port 60. The sheet, which has passed over the exhaust guide 50, is exhausted from the first exhaust port 60 by means of a group of driving rollers 62.

When thick and hard non-continuous sheets such as postcards are conveyed, the operating member 16 is set in position P2. In this case, the left end (upstream end) of the support frame 31 is slight raised from the horizontal position. Consequently, the driven rollers 3*a* and 3*b* are slightly raised from the driving rollers 4*a* and 4*b*, resulting in a weaker contact force than in the case of position P1. Thus, the thick sheet can be easily passed between the driven rollers 3*a* and 3*b* and the driving rollers 4*a* and 4*b*, and the sheet can be smoothly conveyed. The second exhaust port 64 is selected by the exhaust guide 50 (see FIG. 3B). The printed sheet is guided by the rollers 3*b* and 4*b* and exhausted from the second exhaust port 64. Since the second exhaust port 64 is automatically selected in the case of the printing of a hard sheet, problems such as wrinkling and jamming due to erroneous operations can be prevented.

The operation of conveying continuous sheet will now be described with reference to FIG. 2.

A continuous sheet 90 is fed to the printing unit (6, 7) through the tractor 80. The tractor 80 is removable, and it is not set on the printer body 1 in the normal state. When the tractor 80 is mounted on the printer body 1, the operating member 16 is set in position P3, and the left portion of the support frame 31 is set in the highest position. In this case, the driven roller 3*a* is completely separated from the driving roller 4*a*, and the driven roller 3*b* is put in light contact with the driving roller 4*b*. The second exhaust port 64 is selected by the exhaust guide 50 (see FIG. 3C). The continuous sheet 90, which has been fed to the printing unit (6, 7) through the tractor 80, is by the rollers 3*b* and 4*b* and then exhausted from the second exhaust port 64. In this manner, the continuous sheet 90 can be smoothly fed to the printing unit (6, 7) and can be smoothly exhausted from the second exhaust port 64. Since the tractor 80 is removable, the size of the printer body 1 is reduced.

Figure 5:
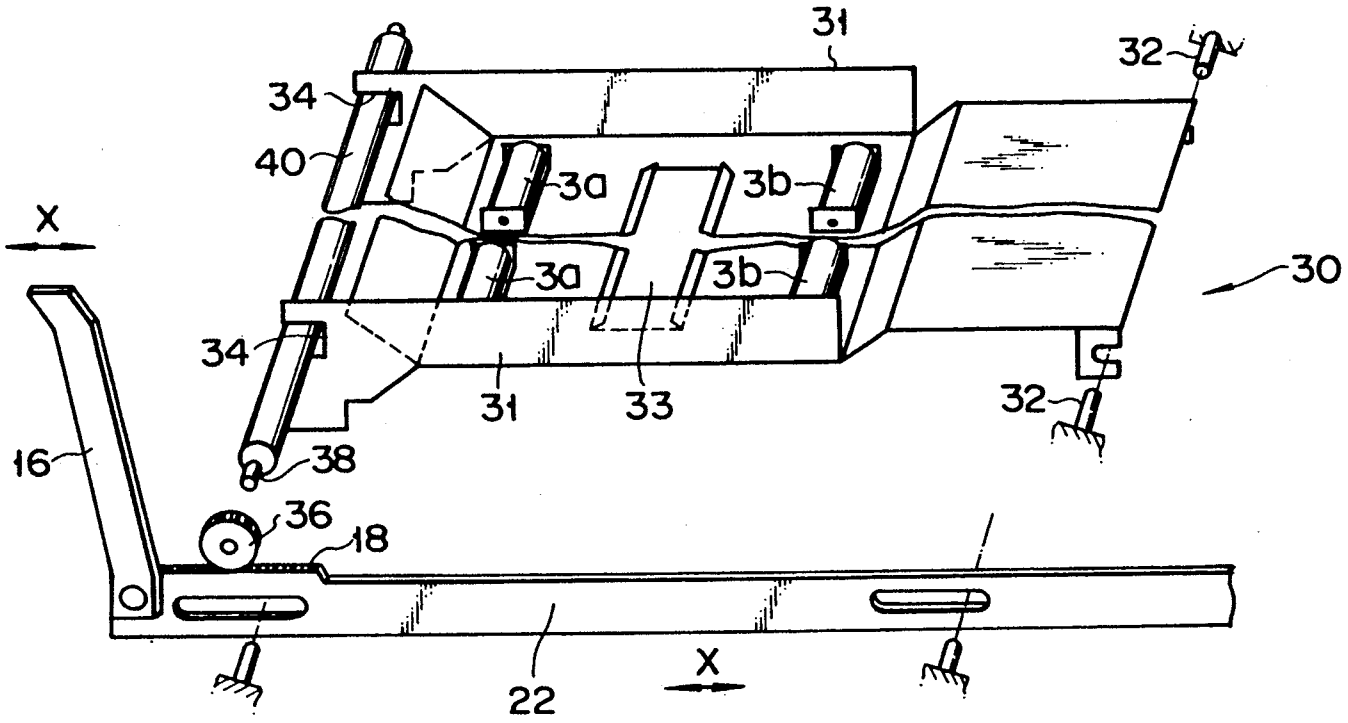
FIG. 5 is a perspective view showing a modification of the convey unit shown in FIG. 4.

FIG. 5 is a perspective view showing a modification of the convey unit 30. In this modification, the sector gear is not used, and the operating member 16 is connected directly to the coupling member 22. A rack 18 is formed on the coupling member 22. The above-mentioned gear 36 is driven by the rack 18. The structure and operation of the other parts are the same as those of the above embodiment.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A sheet conveying apparatus for a printer, comprising:

an apparatus body having first and second sheet exhaust ports;

a printing unit provided in the apparatus body, the printing unit having an upstream side and a downstream side;

a pair of feeding rollers provided on the upstream side of the printing unit and comprising a driving roller and a driven roller for feeding a sheet to the printing unit;

a pair of exhaust rollers provided on the downstream side of the printing unit and comprising a driving roller and a driven roller for conveying the sheet from the printing unit toward the first and second sheet exhaust ports, the pair of exhaust rollers having a downstream side;

a convey unit for rotatably carrying one of the pair of feeding rollers and one of the pair of exhaust rollers;

driving means for driving the convey unit to simulteneously adjust a contact force of the feeding rollers and a contact force of the exhaust roller; and an exhaust direction changing mechanism including: a sheet exhaust guide provided on the downstream side of the exhaust roller; and a coupling member for causing the sheet exhaust guide to select one of the first and second sheet exhaust ports, responsive to a movement of the convey unit driven by the driving means.

2. The apparatus according to claim 1, wherein the convey unit includes a support frame, pivotably supported on the apparatus body, for adjusting the contact force of the feeding rollers differently for the contact force of the exhaust roller.

3. The apparatus according to claim 2, wherein the support frame has an axis about which the support frame is pivoted and which is located on the downstream side of the exhaust roller, the axis supporting both driven rollers rotatably.

4. The apparatus according to claim 3, wherein the driving means includes:

an eccentric roller, engaged with the support frame, for pivoting the support frame; -1 a first gear provided on the eccentric roller; and a sector gear engaged with the first gear.

5. The apparatus according to claim 3, wherein the driving means includes:

an eccentric roller, engaged with the support frame, for pivoting the support frame;

a gear provided on the eccentric roller;

a rack provided on the coupling member and engaged with the gear; and an operating member provided on the coupling member.

6. The apparatus according to claim 5, wherein the apparatus body includes a sheet convey tractor which is removably provided on the upstream side of the printing.

7. A sheet conveying apparatus for a printer, comprising:

an apparatus body having:

a first sheet exhaust port, formed in an upper part of the apparatus body, for exhausting a thin non-continuous sheet; and a second sheet exhaust port, formed in a lower part of the apparatus body, for exhausting a thick non-continuous paper sheet and a continuous paper sheet;

a printing unit provided in the apparatus body, the printing unit having an upstream side and a downstream side;

a pair of feeding rollers provided on the stream side of the printing unit and comprising a driving roller and a driven roller for feeding said sheets to the printing unit;

a pair of exhaust rollers provided on the downstream side of the printing unit and comprising a driving rollers and a driven roller for conveying said sheets from the printing unit toward the first and second sheet exhaust ports, the pair of exhaust rollers having a downstream side;

a support frame having a rotation axis situated on the downstream side of the exhaust rollers, about which the support frame is rotatable, and rotatably supporting the driven roller of the pair of feeding rollers and the divine roller of the pair of exhaust rollers and simultaneously adjusting a contact force of the feeding rollers and a contact force of the exhaust rollers;

a sheet exhaust guide provided on the downstream side of the exhaust rollers, and being movable for selectively guiding the thin paper sheet to the first sheet exhaust port, and the thick paper sheet and the continuous sheet to the second sheet exhaust port; a movable coupling member for moving the sheet exhaust guide, thereby enabling the sheets to be guided towards the coresponding sheet exhaust ports; and driving means for simultaneously moving the coupling member and the support frame.

8. The apparatus according to claim 7, wherein said driving means moves the support frame such that:

when printing is effected on a thin paper sheet, said pair of feeding rollers and said pair of exhaust rollers are both brought into contact with each other with a predetermined contact force;

when printing is effected on a thick paper sheet, said pair of feeding rollers are brought into contact with each other with a contact force weaker than that with which said pair of exhaust rollers are bought into contact with each other; and when printing is effected on a continuous sheet, said pair of feeding rollers are separated from each other and said pair of exhaust rollers are brought into contact with each other with a contact force weaker than when printing is effected on the thick paper sheet.

9. The apparatus according to claim 8, wherein said apparatus body includes a sheet convey tractor, situated on the upstream side of the pair of feeding rollers, for feeding a continuous sheet to the printing unit.

10. The apparatus according to claim 9, wherein the sheet convey tractor is removable from the apparatus body, and wherein when the sheet convey tractor is attached to the apparatus body, the sheet convey tractor actuates drives the driving means.

* * * * *